United States Patent [19]

Bochinski et al.

[11] Patent Number: 4,554,965

[45] Date of Patent: Nov. 26, 1985

[54] BALL-MEASURING SYSTEM FOR SELF-CLEANING HEAT EXCHANGER

[75] Inventors: Rolf Bochinski, Duisburg; Klaus Eimer; Alois Lange, both of Ratingen; Xuan L. Nghiem, Krefeld, all of Fed. Rep. of Germany

[73] Assignee: Taprogge Gesellschaft mbH, Dusseldorf, Fed. Rep. of Germany

[21] Appl. No.: 590,280

[22] Filed: Mar. 16, 1984

[30] Foreign Application Priority Data

Mar. 17, 1983 [DE] Fed. Rep. of Germany ..... 3309509
May 3, 1983 [DE] Fed. Rep. of Germany ..... 3316020

[51] Int. Cl.[4] ..... F28G 1/12

[52] U.S. Cl. ..... 165/95; 134/8; 15/3.5

[58] Field of Search ..... 165/95; 15/3.5, 3.51; 134/8

[56] References Cited

U.S. PATENT DOCUMENTS 3,872,920 3/1975 Honma et al. ..... 165/95
4,314,604 2/1982 Koller ..... 165/95
4,420,038 12/1983 Okouchi et al. ..... 165/95

*Primary Examiner*—William R. Cline
*Assistant Examiner*—Peggy A. Neils
*Attorney, Agent, or Firm*—Karl F. Ross; Herbert Dubno

[57] ABSTRACT

A tube-type heat exchanger having inlet and output conduits and tubes connected therebetween, and a return conduit extending from the output to the inlet conduit is traversed by a coolant liquid from the intake to the output conduit through the tubes. Balls are released into the intake conduit from the return conduit and pass with the coolant through the tubes to clean same. These balls are trapped in the output conduit and introduced back into the return conduit where each ball's momentum is measured and an output corresponding thereto is generated. This output is compared with a set-point signal corresponding to minimum acceptable ball momentum, and any ball whose momentum is below the minimum momentum is withdrawn from the return conduit and replaced in the conduits with a fresh ball.

10 Claims, 8 Drawing Figures

BALL-MEASURING SYSTEM FOR SELF-CLEANING HEAT EXCHANGER

FIELD OF THE INVENTION

The present invention relates to a ball-type self-cleaning heat exchanger. More particularly this invention concerns a method of and apparatus for measuring the size of the scrubbing balls of such a heat exchanger.

BACKGROUND OF THE INVENTION

A tube-type heat exchanger, for example of the type described in my U.S. Pat. No. 3,021,117 or the references cited therein or from copending patent application No. 246,932 filed Mar. 24, 1981, now abandoned, filed can be cleaned by forcing foam-rubber scrubbing balls through its tubes. These balls are introduced into the flow conduit upstream of the heat exchanger and are recovered from the flow conduit downstream of the heat exchanger. They are spongy and are of a diameter that is greater than the inside diameter of the heat-exchanger tubes by 1 mm to 2 mm, so that when they are forced through a heat-exchanger tube they contact it roughly enough to wipe any accumulations from it. This type of arrangement is employed in a power-plant heat exchanger which cannot be shut down for cleaning, since the scrubbing balls can be circulated while it is in operation with only a modest loss in efficiency compared to a complete shutdown.

The heat-exchanger tubes can be continuously cleaned, that is some balls can be continuously circulated through it, or the cleanings can be periodic. Either way it is necessary to monitor the sizes of the scrubbing balls. This size decreases with time, as the balls are worn down by friction with the tubes. The rate of wear is dependent on several factors such as temperature, acidity or basicity, and dirtiness of the coolant water, which factors change often for a heat exchanger cooled, for instance, by a river. Once the balls get too small, it is necessary to replace them with fresh, larger-diameter ones.

European patent application No. 9,137 treats this selection of balls to be replaced purely as a geometric problem, simply determining the ball mesh size. The balls are removed from the system, passed through a sieve of appropriate mesh size, and the balls that can slip through it are discarded and replaced with fresh balls. This system is not efficient, as the procedures are mainly manual so they can only be performed periodically at most. Such periodic cleaning is also disadvantageous in that it must be done quite frequently, to be sure that the tubes are being kept clean when the water is particularly dirty, even though such frequent cleaning is not always necessary. The cost of such periodic cleaning is considerable.

Another problem with such a sieve-based solution is that a standard sieve with holes of regular shape can often reject otherwise too small balls while passing some that are otherwise too large. The orientation of a nonround object is as much a factor determining whether it will go through the sieve or not as is its actual size.

In order to overcome this sensitivity to object shape, which apparently is not solely determinative of cleaning effect, German patent document No. 3,125,493 has proposed passing the balls through a short run of tubing of fairly small diameter. The tubing is somewhat radially expansible and provided with strain gauges so its increase in size as a ball is forced by water pressure through it can be accurately translated into an output largely insensitive to object shape. Nonetheless the results obtained are still not as good as they would seem to be, since with a set of new balls the cleaning results are measurably better, indicating that some ineffective scrubbing balls are being left in the system, and probably that some effective ones are being discarded.

OBJECTS OF THE INVENTION

It is therefore an object of the present invention to provide an improved system for measuring heat-exchanger scrubbing balls.

Another object is the provision of such a system for measuring heat-exchanger scrubbing balls which overcomes the above-given disadvantages, that is which effectively determines which balls should be kept and which should be removed from a heat-exchanger.

SUMMARY OF THE INVENTION

A tube-type heat exchanger having inlet and output conduits and tubes connected therebetween, and a return conduit extending from the output to the inlet conduit is, as is known, traversed by a coolant liquid from the intake to the output conduit through the tubes. Balls are released into the intake conduit from the return conduit and pass with the coolant through the tubes to clean same. According to the invention these balls are trapped in the output conduit and introduced back into the return conduit where each ball's momentum is measured and an output corresponding thereto is generated. This output is compared with a set-point signal corresponding to minimum acceptable ball momentum, and any ball whose momentum is below the minimum momentum is withdrawn from the return conduit and replaced in the conduits with a fresh ball.

The instant invention is based on the surprising discovery that the best feature of the balls to measure is their momentum, which is also known as impulse or kinetic magnitude, and which is the product of the mass and velocity of the object. The momentum of a scrubbing ball can be measured directly or indirectly, even as a function of time. The first derivative of the momentum with respect to time is the product of mass and acceleration, assuming mass is constant.

Corresponding force measurements can be made as friction-force measurements. It is also possible to measure the time it takes the ball to travel along a path, thereby deriving its velocity and making it possible to derive the momentum. Under any circumstances the momentum is a feature that is largely independent of ball unroundness and has been found to be a more accurate measure with respect to scrubbing effectiveness than the pure geometric measurements made hitherto.

As mentioned above, the momentum can be measured according to the invention by passing the balls through a restricted-section passage and measuring the friction on the passage. When the passage is formed by a conduit section which can move relative to the immediately upstream and downstream conduit sections in the ball-travel direction, strain gauges attached to this movable conduit section can accurately measure the friction the ball is exerting on the tube section in excess of the friction exerted by the normally moving liquid. Since this friction is directly related to the cleaning effectiveness of the balls, it makes it particularly easy to accurately sort the balls.

The momentum of the balls can also be measured by causing them to strike an impact plate and measuring the force of the impact, or by passing them through a restricted-section passage and measuring the static pressure in front of and behind each of them. Another method according to this invention is passing them through a restricted-section passage and measuring the time it takes each of them to travel a predetermined distance therein. Any of these measurements can easily be done by state-of-the-art strain-gauge sensors that convert the stress applied to them into a change in resistance or capacitance that can be used in an analog or digital system. The outputs can also be added, integrated, averaged, stored, and so on, as well of course as displayed.

The apparatus according to the present invention includes sensor means in the return conduit for measuring the momentum of balls passing therethrough and for generating an output corresponding thereto, control means connected to the sensor means for receiving the output and comparing it with a set-point signal corresponding to minimum acceptable ball momentum, and selector means connected to the control means for withdrawing from the return conduit a ball whose momentum determined by the sensor and control means is below the minimum momentum and for replacing the withdrawn ball in the conduits with a fresh ball.

This control means can further include a memory for storing the momentums of a sequence of balls within a given time period. It works with adjustable means for generating the set-point signal and feeding it to the control means.

The sensor according to this invention can be provided in the return conduit so that all balls passing therethrough are measured. The return conduit also can have a shunt conduit provided with the sensor means and is provided in parallel with the shunt conduit with a flow restriction. Thus only some of the balls pass through the sensor means each time. In addition a pump can be provided in this shunt line to control the passage of balls through the sensor.

DESCRIPTION OF THE DRAWING

The above and other features and advantages will become more readily apparent from the following, reference being made to the accompanying drawing in which.

SPECIFIC DESCRIPTION

Figure 1:
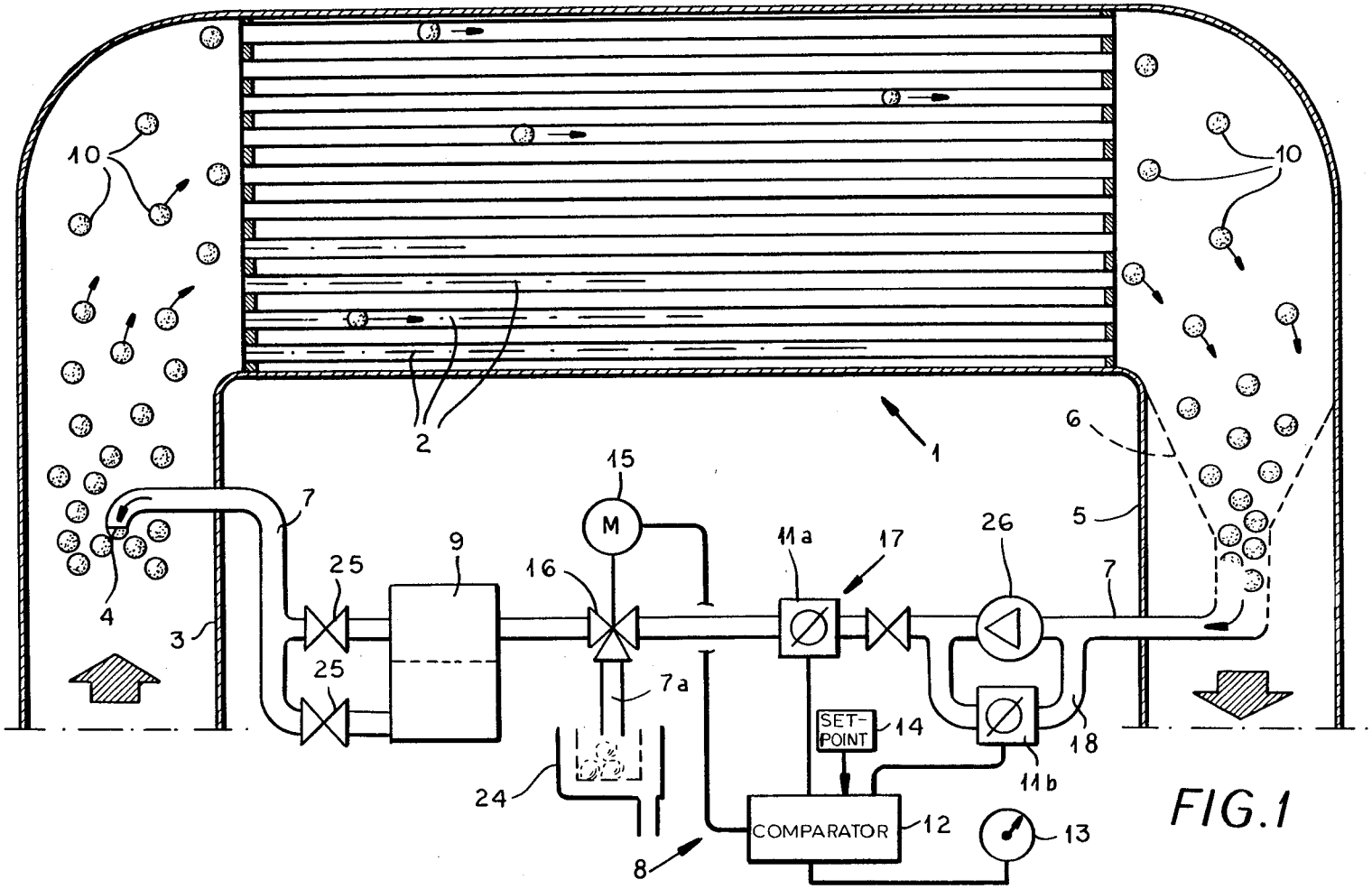
FIG. 1 is a largely schematic view of the system of this invention.

As seen in FIG. 1 a heat exchanger 1 has a multiplicity of parallel small-diameter tubes 2 that extend parallel to one another across a flow which in FIG. 1 is vertical, between the tubes 2. The coolant water enters the tubes 2 from an intake conduit 3 and exits from the opposite ends of the tubes 2 via an output conduit 5. Heat is exchanged through the tube walls between the relatively cool water in the tubes 2 and the warmer reactor water passing around them.

In order to scrub deposits from inside the small-diameter tubes 2 without shutting down the system and opening up the pipes, and even without stopping its normal operation, small-diameter sponge scrubbing balls 10 are introduced by a feed conduit 4 into the intake conduit 3 and a sieve funnel 6 traps them in tne output conduit 5. Thus periodically or even continuously these small-diameter balls 10 are released into the coolant circuit to pass through and scrub tne tube 2.

The balls 10 taken out of the conduit 5 enter a return conduit 7 that extends between and allows limited liquid flow between the output and intake conduits 5 and 3 and that is mainly of sufficient flow cross section to provide little impedance to the trapped sponge balls 2 moving with this shunt flow. This conduit 7 passes through at least one sensing location 17 provided with a sensor **11*a* connected to a control arrangement 8 that can operate a servomotor 15 of a downstream three-way valve 16 that can shunt too-small balls into a receptacle 19. Downstream therefrom is a standard device 9 for holding back passed balls and for releasing new balls, whence the conduit 7 leads to the feed pipe 4**.

The controller 8 comprises a microprocessor 12 functioning as a comparator which receives from the sensor **11*a* an actual-value output proportional to the momentum of the ball 10 passing through it, and from an adjustable source 14 a set-point signal corresponding to minimum ball momentum. An indicator 13 can be connected to this comparator 12 also. Valves 25 downstream of the device 9** can let the acceptable balls pass through the system, or release new ones into it. Shutting both of them closes down the ball-recirculating equipment.

It is possible as illustrated to have the sensor **11*a* provided right in the return line 7 so that all of the balls pass through it once during each circuit. It is also possible to provide a short shunt conduit 18 across a restriction valve 26 in the line 7. This valve 26 can be closed somewhat to divert at least part of the return flow in the conduit 7 through the loop 18 and through a sensor 11*b* therein. With such an arrangement, therefore, if 10% of the flow is diverted through the shunt 18, on the average each ball 10 will pass one time in ten through the sensor 11*b***. As the wear of the balls is a fairly gradual process, such periodic testing is normally sufficient to weed out the ineffective balls.

Figure 2:
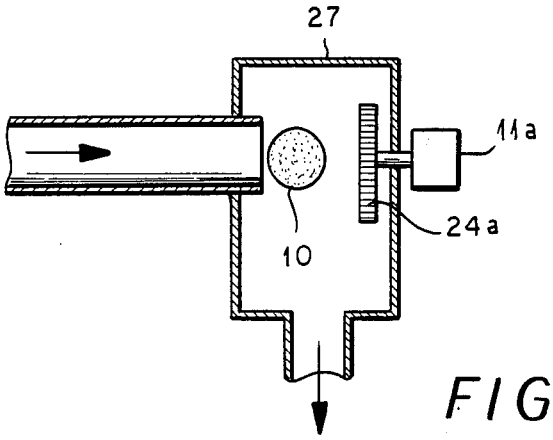
FIGS. 2 through 8 are mainly schematic views illustrating momentum detectors according to this invention.
Figure 3:
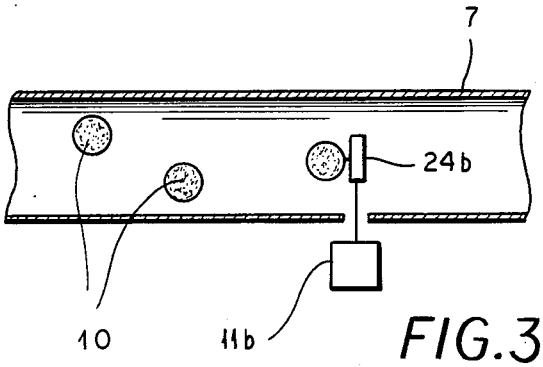
Figure 4:
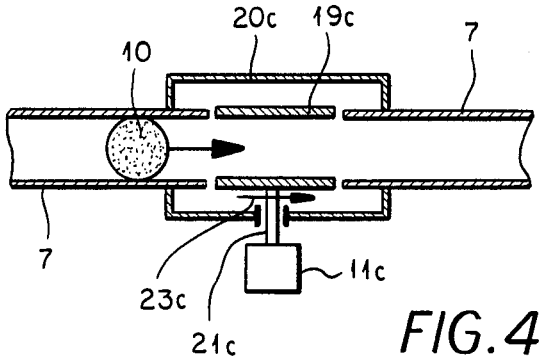
Figure 5:
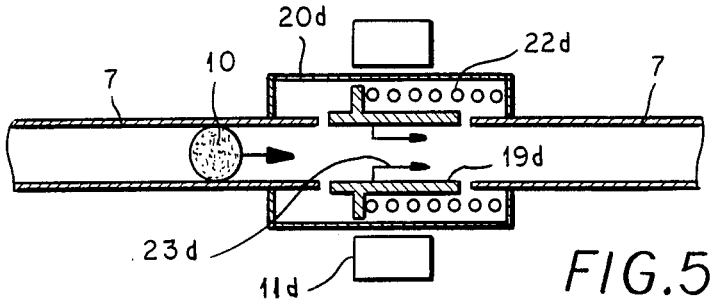

The sensor **11*a* has as shown in FIG. 2 a housing 27 having a lateral intake aligned with an impact plate 24*a* connected to the sensor, and an output perpendicular thereto. Thus incoming balls 10 impinge directly on the plate 24*a*, converting their momentum into a proportional stress translated by the sensor 11*a* into an output corresponding to this momentum. A similar procedure is used in FIG. 3 where a small-diameter plate 24*b* is aligned in the middle of a straight section of the conduit 7. The sensor 11*b* here detects deflection in the flow direction of the impact plate 24*b* as it is impacted by successive balls, registering a stress that is proportional to ball momentum In FIG. 4 the friction developed by the ball 10 as it traverses a short tubing section 19*c* is registered by providing this section 19*c* in a housing 20*c* slightly separate from the flanking sections of the conduit 7 and mounting this section 19*c* on a deflectable shaft 21*c* of a sensor 11*c* incorporating strain gauges that can measure displacement in the direction 23*c* of the section 19*c*. This friction is a direct function of the ball momentum. FIG. 5 shows an arrangement that functions similarly. It has a section 19*d* displaceable in the ball-travel direction 23*d* in a housing 20*d* against the force of a spring 22*d*. The sensor 11*d* here detects displacement of the sections 19*d* parallel to the tube 7**, registering friction as described.

Figure 6:
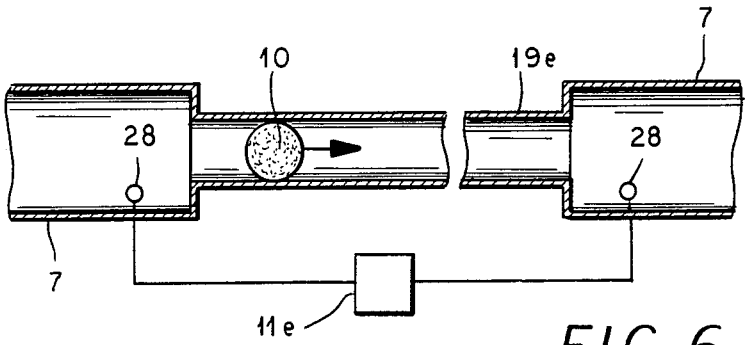

In FIG. 6 the pressure difference between the upstream and downstream end of a small-diameter conduit section 19*e* provided in the conduit 7 is measured by upstream and downstream pressure sensors 28. Thus the static pressure is measured to both sides of the ball in the section 19*e*, and the difference calculated by the sensor 11*e*, this difference being proportional to the resistance to passage of the ball in the section 19*e* and therefore to its friction and momentum.

Figure 7:
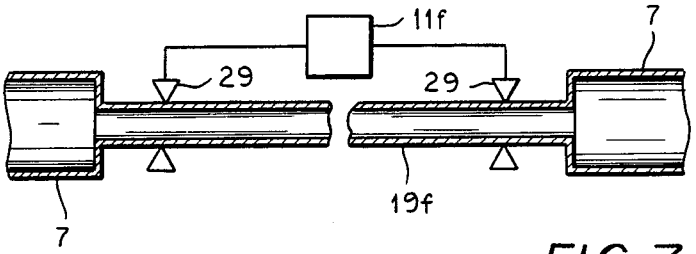
Figure 8:
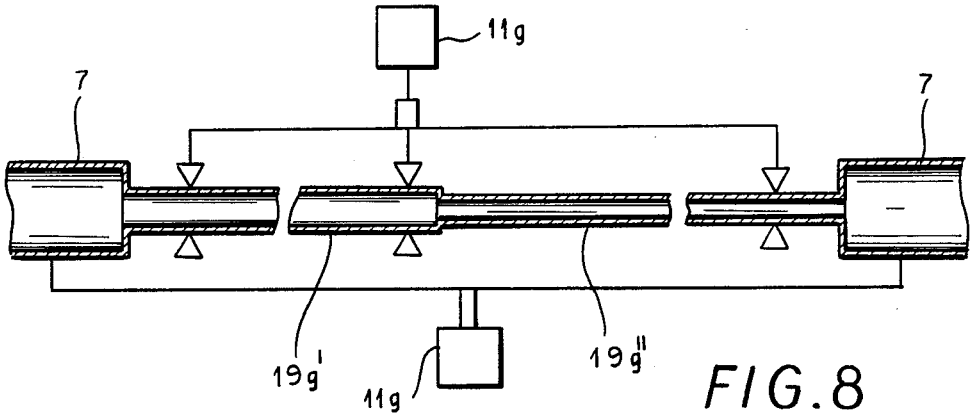

The system of FIG. 7 has motion detectors 29 spaced apart in a small-diameter conduit section 19*f* interposed in the return conduit 7. The sensor 11*f* here incorporates circuitry to measure the time it takes a ball 10 to move in the section 19*f* between the detectors 29. Once again this travel time is proportional to the friction and momentum of the ball. In FIG. 8 three such detectors 29 are provided in a pair of tubing sections 19*g*′ and 19*g*″. The upstream section 19*g*′ is of slightly greater diameter than the downstream section 19*g*″, so that two measurements in differently sized sections can be made. This allows the sensor 11*g* to measure over a wider range than the sensor 11*f*.

We claim:

1. A method of operating a tube-type heat exchanger having intake and output conduits and tubes connected therebetween, and a return conduit extending from the output to the inlet conduit, the method comprising the steps of:

passing a coolant liquid from the intake to the output conduit through the tubes;

releasing balls into the intake conduit from the return conduit and passing the balls with the coolant through the tubes to clean same;

trapping balls in the output conduit and introducing them into the return conduit;

measuring the momentum of each of the balls in the return conduit and generating respective outputs corresponding thereto;

comparing the outputs with a set-point signal corresponding to minimum acceptable ball momentum; and withdrawing from the return conduit a ball whose momentum is below the minimum momentum and replacing the withdrawn ball in the conduits with a fresh ball.

2. The method defined in claim 1 wherein the momentum of the balls is measured by passing them through a restricted-section passage and measuring the friction on the passage.

3. The method defined in claim 1 wherein the momentum of the balls is measured by causing them to strike an impact plate and measuring the force of the impact.

4. The method defined in claim 1 wherein the momentum of the balls is measured by passing them through a restricted-section passage and measuring the static pressure in front of and behind each of them.

5. The method defined in claim 1 wherein the momentum of the balls is measured by passing them through a restricted-section passage and measuring the time it takes each of them to travel a predetermined distance therein.

6. In combination with a tube-type heat exchanger having inlet and output conduits and tubes connected therebetween, and a return conduit extending from the output to the inlet conduit and provided in the output conduit with means for trapping balls therein and introducing same into the return conduit and in the inlet conduit with means for releasing balls thereinto from the return conduit, a ball-testing apparatus comprising:

sensor means in the return conduit for measuring the momentum of balls passing therethrough and for generating an output corresponding thereto;

control means connected to the sensor means for receiving the output and comparing it with a set-point signal corresponding to minimum acceptable ball momentum; and selector means connected to the control means for withdrawing from the return conduit a ball whose momentum determined by the sensor and control means is below the minimum momentum and for replacing the withdrawn ball in the conduits with a fresh ball.

7. The apparatus defined in claim 6 wherein the control means includes memory means for storing the momentums of a sequence of balls within a given time period.

8. The apparatus defined in claim 6, further comprising adjustable means for generating the set-point signal and feeding it to the control means.

9. The apparatus defined in claim 6 wherein the sensor means is provided in the return conduit and all balls passing therethrough are measured by the sensor means.

10. The apparatus defined in claim 6 wherein the return conduit has a shunt conduit provided with the sensor means and is provided in parallel with the shunt conduit with a flow restriction.

* * * * *